US006193103B1

(12) United States Patent
Clarijs

(10) Patent No.: US 6,193,103 B1
(45) Date of Patent: Feb. 27, 2001

(54) PILL DISPENSER

(75) Inventor: Caroline Clarijs, Delft (NL)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/202,587

(22) PCT Filed: Jun. 10, 1997

(86) PCT No.: PCT/EP97/03069

§ 371 Date: Feb. 4, 1999

§ 102(e) Date: Feb. 4, 1999

(87) PCT Pub. No.: WO97/47534

PCT Pub. Date: Dec. 18, 1997

(30) Foreign Application Priority Data

Jun. 14, 1996 (EP) ..... 96200354

(51) Int. Cl.[7] ..... G07F 11/66; G07F 11/68; B65H 5/28

(52) U.S. Cl. ..... 221/25; 221/72; 221/197

(58) Field of Search ..... 221/25, 72, 86, 221/88, 89, 90, 91, 197

(56) References Cited

U.S. PATENT DOCUMENTS 3,557,747 1/1971 Rigney .
5,154,296 * 10/1992 Cutler ..... 221/91 X
5,464,118 * 11/1995 Grau et al. ..... 221/88 X
5,664,697 * 9/1997 Lambelet, Jr. et al. ..... 221/86 X

FOREIGN PATENT DOCUMENTS 456 846 7/1968 (CH) .
0 104 710 9/1983 (EP) .

* cited by examiner

*Primary Examiner*—Christopher P. Ellis
*Assistant Examiner*—Gene O. Crawford
(74) *Attorney, Agent, or Firm*—William M. Blackstone

(57) ABSTRACT

A pill dispenser for releasably holding a collection of pills. The dispenser having a base plate and a cover rotatably mounted relative to the base plate. The collection of pills are housed individually in compartments in the holding means and an aperture allows for selective release of the pills. At least one notch is provided and travels along a toothed circular guide path when the cover is rotated. An baffle extends inwardly from the aperture in the direction of the compartments of the holding means and prevents rotation past pills in a compartment without removing the pill next in sequence from its holder so that no pills may be skipped.

10 Claims, 3 Drawing Sheets

PILL DISPENSER

The invention concerns a pill dispenser comprising a base plate and a cover rotatably mounted relative to the base plate, holding means for releasably holding a collection of pills, and an aperture for selectively releasing a pill, wherein the dispenser includes at least one notch and a toothed circular guide path for the at least one notch.

As used in this description, pills are deemed to comprise also capsules, coated and non-coated tablets, and any other pharmaceutical drug in solid state, and kept in the dispenser in any suitable position, such as upright or on the side.

Such a pill dispenser is known from U.S. Pat. No. 3,557,747 teaching a dispenser comprising a tablet ring rotatably mounted relative to both the cover and the base plate. The tablet ring comprises a circular series of notches having the shape of a saw-tooth and intended to cooperate with a toothed circular guide path provided on the base plate. This construction is intended to prevent rotation of the tablet ring relative to the base plate in the counter clockwise direction. For initial use the known pill dispenser required rotation of the cover until an indicia on the base plate exposed through an aperture in the cover, indicates the date on which the first pill is to be taken.

The known pill dispenser has the disadvantage that is requires rotation of the parts thereof by manual operation, which can be hard for people with a problematic bone structure. A further problem is that the known pill dispenser allows the sequence of pills to be broken, in that it is possible to rotate the cover relative to the base plate by more than one position.

The invention intends to overcome these problems and to realize further goals which will be explained hereafter.

The pill dispenser according to the invention is characterized in that the toothed guide path comprises an upper and lower rim defining said guide path, and both essentially shaped in the form of a saw-tooth, whereby the at least one notch is provided in between said upper and lower rim, and whereby the guide path and the at least one notch are provided on the cover and the base plate, which are movable in the axial direction relative to each other between a proximate and a distant position so as to cause movement of the at least on notch along the said rims of the toothed guide path in the direction defined by the shaped saw-tooth, and to effect corresponding rotation of the cover relative to the base plate. Rotation of the cover relative to the base plate can now simply be effected by pressing the cover while the dispenser is on the table, or alternatively, by pressing base plate and cover towards each other while holding the dispenser between the thumb and fingers of one hand. Repeated pressing of the cover towards the base plate alternated with repeated removal of pills makes the pills of subsequent days available for use. The link between each of the pills in the dispenser, and the subsequent days to which they relate, can simply be given by providing a day-indicator on a part on top of the dispenser which is fixed relative to the holding means for the pills. In this way the orientation of the days on the day-indicator is fixed with respect to the pills contained in the dispenser. It is further to be noted that the pill dispenser according to the invention is tolerant with respect to its sizing; it can be given any suitable size ranging from pocket-size to any larger class of sizes.

The pill dispenser according to the invention can suitably be provided with a monitoring device in order to registrate actuation of the dispenser, time and date of actuation, etcetera.

Preferably, the pill dispenser includes a spring providing a force to the cover and the base plate in their axial direction to promote their assuming the distant position. The spring constant can then be selected to honour both ease of operation and sufficient resistance to withstand unintended operation while the dispenser is kept for instance in a ladies bag.

In one aspect of the invention the pill dispenser according to the invention has the feature that in the distant position of the cover and the base plate, the at least one notch rests in a recess provided in the toothed guide path. This recess provides the secure and accurate positioning of the cover relative to the base plate. When assuming this distant position the aperture in the cover for release of a pill is always located immediately in front of the one pill which is intended to be released from the dispenser while securing the remainder of the pills under the cover of the dispenser.

Preferably, there are multiple recesses, the number of which corresponding to the maximum number of pills for which the dispenser is suited, and each recess defining a position of the aperture for release of one pill.

In a further aspect of the invention the recess or recesses are provided in only one of the rims, and during movement of the cover and base plate to the proximate position, the notch abuts against the rim opposite to the recess or recesses, while during movement of the cover and base plate to the distant position the notch abuts against the rim provided with the recess or recesses. This construction provides a very secure operation of the pill dispenser preventing unintended rotation of the cover relative to the base plate in the opposite direction.

In a preferred embodiment, the aperture is provided in the cover, and means are provided for initial closure thereof prior to the release of the first of a complete series of pills, and/or for closing the aperture when desired during any moment thereafter.

In a further preferred embodiment, the cover of the pill dispenser according to the invention is provided with a baffle extending inwards from the edge of the aperture into the direction of the holding means for the pills, which holding means are realized as a circular row of compartments, each compartment suited for holding one pill and being too narrow for receiving the baffle when loaded with one such pill. This provision prevents the unintended skipping of a subsequent pill to be retained from the pill dispenser. Further rotation of the cover relative to the base plate is only possible after removing the pill which has been selected next for removal.

The pill dispenser according to the invention is suited for refills by the consumer. In an alternative embodiment, refilling is supported by providing the aperture in the base plate which is then shaped substantially circular near the base plate's outer circumference, and that the base plate comprises holding means for a blister pack containing the pills, whereby the cover has a projection extending inwards and abutting against the blister pack so as to release one of the pills contained in the blister pack when the cover and the base plate are placed in the proximate position.

In a further preferred embodiment, the pill dispenser has at least three, and preferably at least four notches irregularly distributed along the circumference of the toothed guide path. This renders the pill dispenser according to the invention rather tolerant with respect to the spot and direction of the forces applied to the cover and base plate. With less than four notches the pill dispenser would be rather sensitive in this respect, resulting in pushing these two components out of alignment when the force is not applied exactly in the middle or is improperly directed. Moreover, the irregular disposition of the notches along the circumference of the toothed guide path prevents undesirable or premature opening of the dispenser due to the circumstance that only one orientation, being the initial position of base plate relative to cover, is suited for disassembly and reassembly of the dispenser.

In still another preferred embodiment, the pill dispenser according to the invention is characterized in that each notch is provided on the cover and the base plate is provided with channels giving the notches access to the toothed guide path. This allows for ease of assembly, both at the factory and by the consumer, when the pill dispenser is of the reusable type and the dispenser requires recharging with a new complete collection of pills.

The invention is further explained referring to the drawing, in which

Figure 3A:
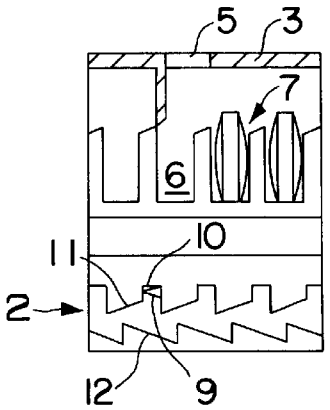
Figure 3B:
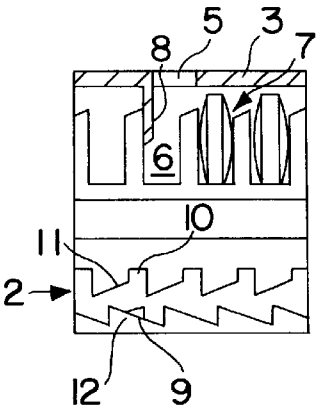
Figure 3C:
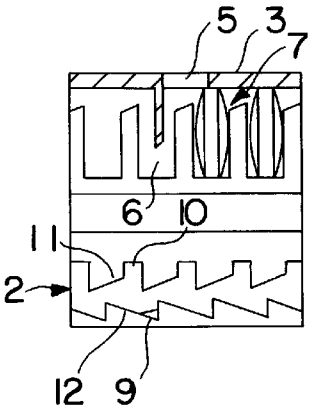
Figure 3D:
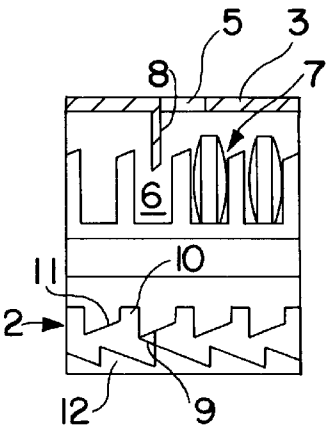
Figure 3E:
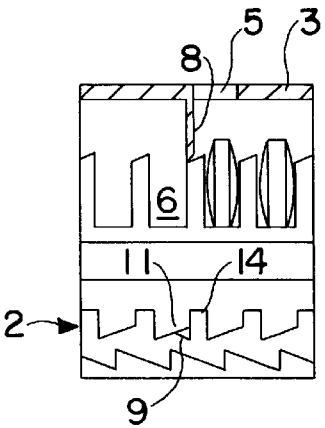
Figure 3F:
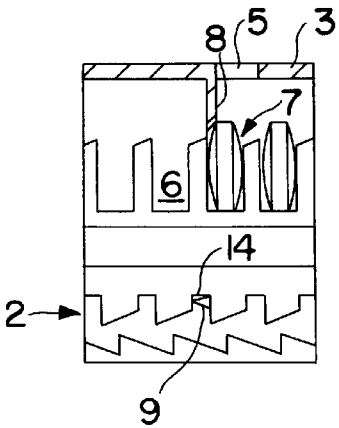
Figure 4:
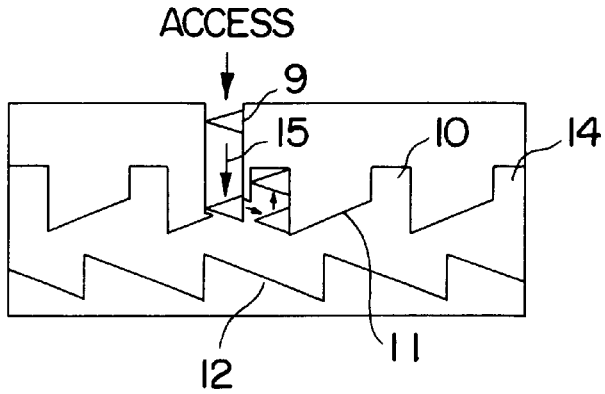

FIG. 3*a–f* is a schematic representation of the subsequent movement of the cover relative to the base plate during operation of the pill dispenser; and FIG. 4 shows a detail of the base plate comprised in the pill dispenser according to the invention.

Figure 5:
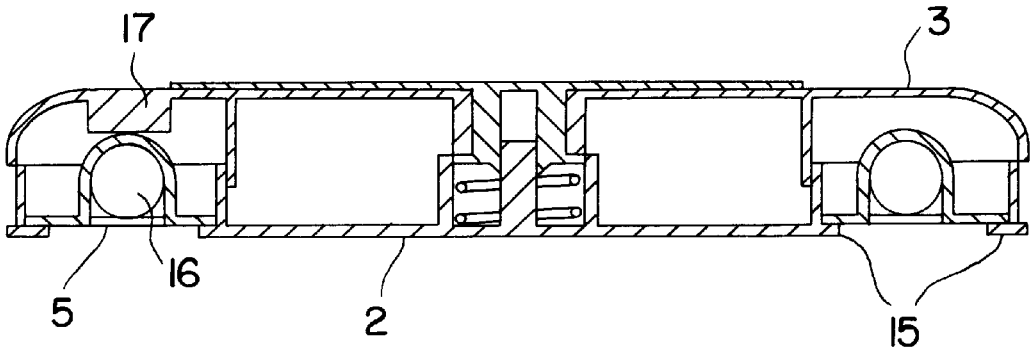

FIG. 5 shows a sectional view of the pill dispenser according to the invention suited for refill with a blister pack.

Whenever reference is made to the same parts of the pill dispenser, use is made of like reference numerals.

Figure 1:
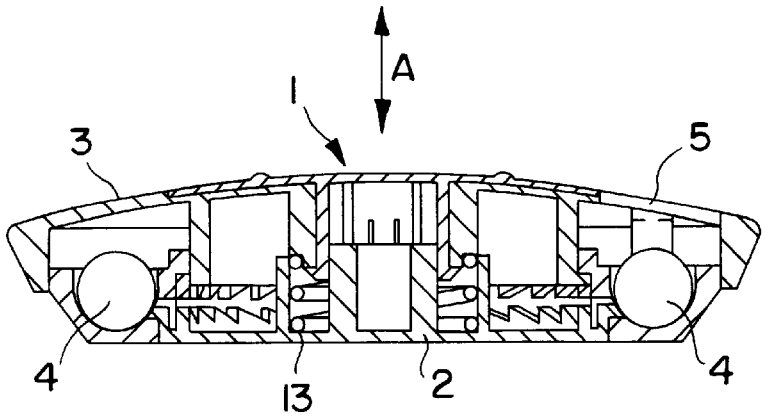
FIG. 1 shows a transverse section of the pill dispenser according to the invention.

FIG. 1 shows a pill dispenser comprising a base plate 2 and a cover 3 rotatably mounted relative to the base plate 2. Further, the pill dispenser includes holding means 4 for releasably holding a collection of pills. The cover 3 has an aperture 5 for selectively releasing a pill, which may be provided with closure means. When no such closure means are provided, normally the dispenser, or at least the aperture, is sealed when sold. The cover 3 and the base plate 2 are rotatably mounted with respect to each other, but also movable in the axial direction as indicated by arrow A. FIG. 1 further shows the optional day-indicator 1, which does not rotate and thus is fixed with respect to the pills.

FIG. 1 shows the pill dispenser when the cover and the base plate are in the distant position. When pressing and subsequently releasing the cover 3 and the base plate 2, a rotation of cover 3 with respect to the base plate 2 will occur as will be explained referring to FIG. 3.

FIG. 3*a* shows an initial position of the pill dispenser in which the cover 3 with the aperture 5 is located near a compartment 6 from which a pill (not shown) has been discharged through the aperture 5. In a further compartment 7, a subsequent pill is residing waiting for release through the aperture 5. To effect this, the cover 3 is pressed in the direction of the base plate 2 whereby a baffle 8 extends in the compartment 6 previously holding a pill. A notch 9 is connected to the cover 3 and lowered from a recess 10 provided at the upper rim 11 of a guide path. The guide path further comprises a lower rim 12; both rims 11 and 12 are connected to the base plate 2. By lowering the cover 3 the notch 9 eventually abuts against the lower rim 12 which is opposite to the recess 10 and by further pressing of the cover 3 the recess 9 moves along the path defined by the saw-tooth of the lower rim 12 until it reaches the position shown in FIG. 3*c*, being the proximate position of cover 3 and base plate 2. The next action is to release the cover 3 allowing it to move upward under the influence of the spring 13 shown in FIG. 1 towards the distant position. This causes the notch 9 to move upwards departing from the lower rim 12 upper rim 11 until it abuts against said upper rim as shown in FIG. 3*d*. Further release of the cover 3 causes the notch 9 to travel along the upper rim 11 (FIG. 3*e*) until it reaches a next recess 14 as shown in FIG. 3*f*. In this position the pill in compartment 7 is ready for discharge through aperture 5. FIG. 3*f* clearly shows further that when the pill is not yet removed from compartment 7, the baffle 8 projecting to the interior of the pill dispenser prevents further movement of the cover 3 towards the base plate 2 due to the circumstance that the width of compartment 7 is insufficient to both receive the baffle 8 and to hold the pill. After removal of the pill from compartment 7, the situation shown in FIG. 3*f* identifies with the situation shown in FIG. 3*a*.

Figure 2A:
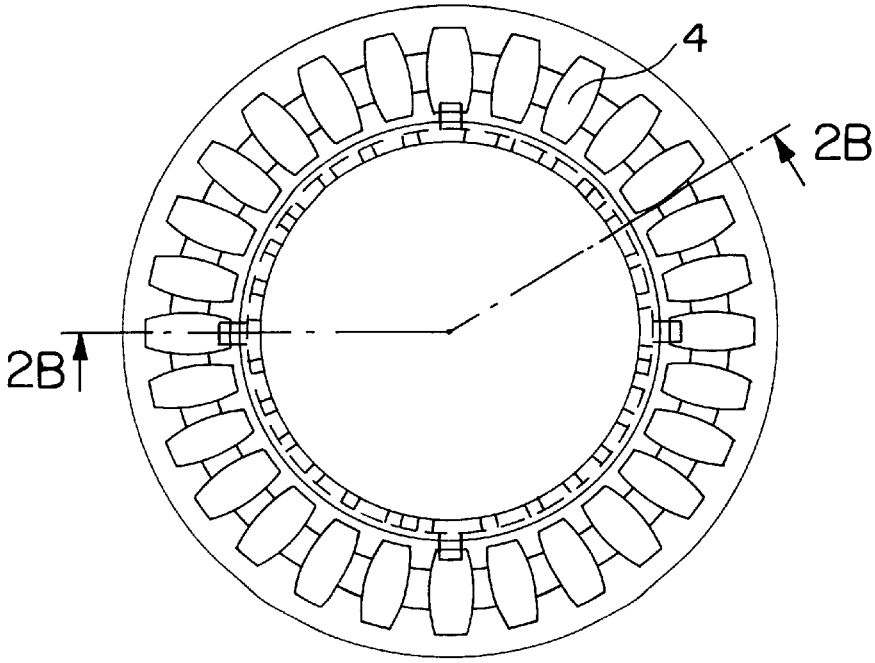
FIG. 2 shows a top view and a sectional part of the base plate of the dispenser according to the invention along the line A—A shown in said tope view.
Figure 2B:
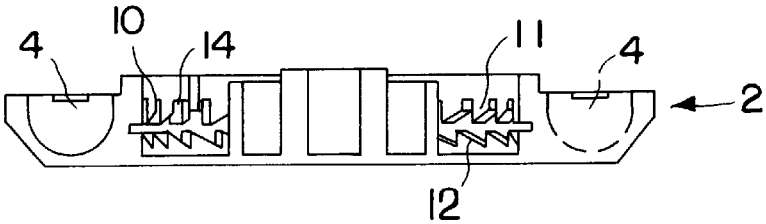

FIG. 2 shows a top view and a sectional view of the base plate 2 with the holding means 4 for holding a collection of pills in the form of a circular series of compartments 4. At the inner circumference of the base plate 2 the upper rim 11 and lower rim 12 are shown. The upper rim 11 is provided with recesses 10 and 14 corresponding to certain compartments of the holding means 4 for the pills. The upper rim 11 and lower rim 12 together provide the toothed circular guide path for the notch 9 according to the invention. A preferred embodiment includes at least three, and preferably at least four of such notches irregularly distributed along the circumference of the toothed guide path providing effective prevention of misalignment of the cover 3 relative to the base plate 2 when pressing both towards each other.

FIG. 4 schematically shows the guide path with the upper rim 11, the lower rim 12 and subsequent recesses 10 and 14 in the upper rim 11. This Figure demonstrates the due of a channel 15 in order to allow access for notches such as notch 9, when assembling the cover 3 and the base plate 2. The notch then travels through channel 15 until it reaches the guide path bordered by the upper rim 11 and lower rim 12.

FIG. 5 shows an alternative embodiment of the pill dispenser according to the invention, in which the aperture 5 is provided in the base plate 2 and substantially shaped circular near the outer circumference of the base plate 2. The base plate 2 comprises holding means 15 for a blister pack 16 in which the pills are contained. The cover 3 is provided with a projection 17 extending inwards and abutting against the blister pack, as is clearly shown in the drawing. When the cover 3 and the base plate 2 are placed in the proximate position, the projection 17 causes the pill immediately located thereunder to release from the blister pack and leave the dispenser through the aperture 5. The dispenser of FIG. 5 does not have a day-indicator, but if required a day-indicator as in FIG. 1 (l) can be provided. Alternatively, a day indication can also be provided on the blister package, making a day-indicator on the dispenser superfluous.

What is claimed is:

1. A pill dispenser comprising a base plate and a cover rotatably mounted relative to the base plate, holding means for releasably holding a collection of pills, and an aperture for selectively releasing a pill, wherein the dispenser includes at least one notch and a toothed circular guide path for the at least one notch, wherein the toothed circular guide path comprises an upper and a lower rim defining said guide path, and both rims are essentially shaped in the form of a saw-tooth, whereby the at least one notch is provided in between said upper and lower rim, and whereby the guide path and the at least one notch are provided separately on the cover and the base plate, which are movable in the axial direction relative to each other between a proximate and a distant position so as to cause movement of the at least one notch along the said rims of the toothed guide path in the direction defined by the shape of the saw-tooth, and to effect corresponding rotation of the cover relative to the base plate, wherein the cover of said pill dispenser further comprises a baffle extending inwards from the edge of the aperture into the direction of the holding means for the pills, which holding means comprises compartments, each compartment suited for holding at least one pill and being too narrow for receiving the baffle when loaded with the at least one pill.

2. The pill dispenser according to claim 1, which includes a spring providing a force to the cover and the base plate in their axial direction to promote their assuming the distant position.

3. The pill dispenser according to claim 1, wherein the aperture is provided in the cover and wherein means are provided for initial closure thereof prior to the release of the first of a complete series of pills and/or for closing the aperture whenever desired.

4. The pill dispenser according to claim 1, wherein the aperture is provided in the base plate and shaped substantially circular near the base plate's outer circumference, and wherein the base plate comprises holding means for a blister pack containing the pills, whereby the cover has a projection extending inwards and abutting against the blister pack so as to release one of the pills contained in the blister pack when the cover and the base plate are placed in the proximate position.

5. The pill dispenser according to claim 1, wherein there are at least three, and preferably at least four notches, irregularly distributed along the circumference of the toothed guide path.

6. The pill dispenser according to claim 1, wherein each notch is provided on the cover and the base plate is provided with channels giving the notches access to the toothed guide path.

7. The pill dispenser according to claim 1, wherein in the distant position of the cover and the base plate, the at least one notch rests in a recess provided in the toothed guide path.

8. The pill dispenser according to claim 7, wherein the recess is provided in only one of the rims and wherein during movement of the cover and base plate to the proximate position the notch abuts against the rim opposite to the recess, and wherein during movement of the cover and base plate to the distant position the notch abuts against the rim provided with the recess.

9. The pill dispenser according to claim 7, wherein there are multiple recesses, the number of which corresponding to the maximum number of pills for which the dispenser is suited, and each recess defining a position of the aperture for release of one pill.

10. The pill dispenser according to claim 9, wherein the recesses are provided in only one of the rims and wherein during movement of the cover and base plate to the proximate position the notch abuts against rim opposite to the recesses, and wherein during movement of the cover and base plate to the distant position the notch abuts against the rim provided with the recesses.

* * * * *